US005082091A

United States Patent [19]

Fargo

[11] Patent Number: 5,082,091

[45] Date of Patent: Jan. 21, 1992

[54] HYDRAULIC ELEVATOR CONTROL

[75] Inventor: Richard N. Fargo, Plainville, Conn.

[73] Assignee: Otis Elevator Company

[21] Appl. No.: 589,875

[22] Filed: Sep. 28, 1990

Related U.S. Application Data

[63] Continuation-in-part of Ser. No. 467,445, Jan. 19, 1990, Pat. No. 5,014,824.

[51] Int. Cl.[5] ..... B66B 11/04

[52] U.S. Cl. ..... 187/17; 187/29.2; 91/454

[58] Field of Search ..... 187/17, 38, 110, 111, 187/29.2; 91/452, 454, 446, 469, 448; 60/60, 477, 452

[56] References Cited

U.S. PATENT DOCUMENTS

| | | | |
|---|---|---|---|
| 2,563,295 | 8/1951 | Westbury | 91/454 |
| 4,557,180 | 12/1985 | Glomeau | 91/446 |
| 4,676,140 | 6/1987 | Haussler | 91/452 |

FOREIGN PATENT DOCUMENTS

| | | |
|---|---|---|
| 227296 | 11/1986 | European Pat. Off. . |
| 3836212 | 5/1989 | Fed. Rep. of Germany . |

*Primary Examiner*—D. Glenn Dayoan
*Assistant Examiner*—Kenneth Noland
*Attorney, Agent, or Firm*—Lloyd D. Doigan

[57] ABSTRACT

The flow of hydraulic fluid to and from an hydraulic elevator piston is controlled by a motor-actuated spool valve operated by a microprocessor. To lower the elevator, a main check valve is opened by a down piston using hydraulic fluid from the system. Pressure is equalized on both sides of the main check valve just before the latter is opened thereby allowing the use of a smaller down piston which uses less hydraulic fluid. This results in smoother car motion during descent of the car. The addition of a valve bleed passage to equalize pressure on both sides of the check valve also prevents rapid descent of the elevator car in the event that the spool valve were to be open at the time descent commences.

3 Claims, 1 Drawing Sheet

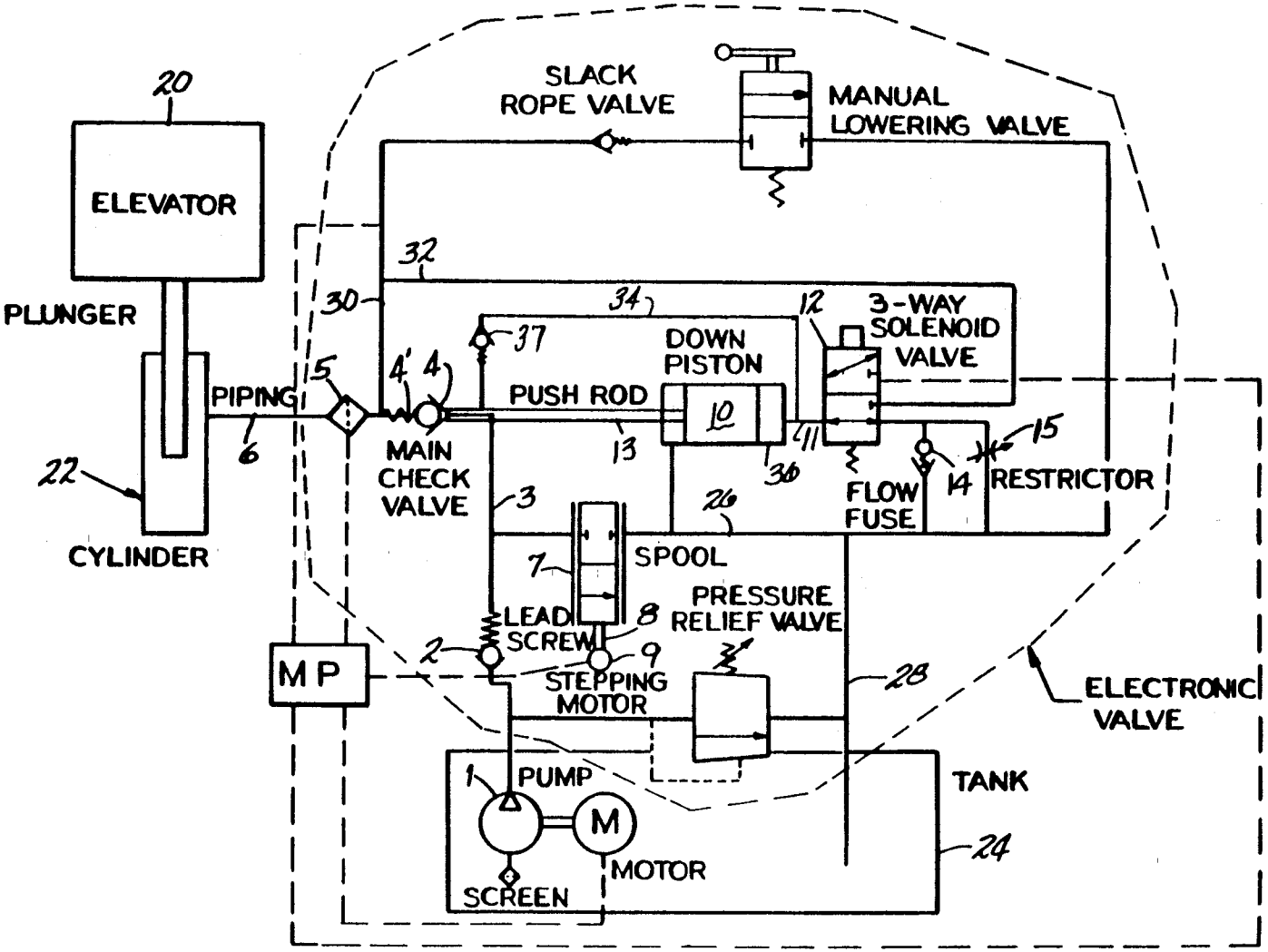
ELECTRONIC VALVE
MANUAL LOWERING VALVE
3-WAY SOLENOID VALVE
RESTRICTOR
FLOW FUSE
TANK
SLACK ROPE VALVE
DOWN PISTON
SPOOL
PRESSURE RELIEF VALVE
PUSH ROD
LEAD SCREW
STEPPING MOTOR
MOTOR
PUMP
SCREEN
MAIN CHECK VALVE
MP
PIPING
ELEVATOR
PLUNGER
CYLINDER

HYDRAULIC ELEVATOR CONTROL

This Application is a Continuation-in-Part of Ser. No. 07/467,445, filed Jan. 19, 1990 now U.S. Pat. No. 5,014,824 and is commonly owned by the Assignee herein.

TECHNICAL FIELD

This invention relates to a system for supplying and withdrawing hydraulic fluid to and from an hydraulic elevator plunger/cylinder assembly, and more particularly, to a simplified system wherein downward movement of the elevator is smoother and safer.

BACKGROUND ART

U.S. Pat. Nos. 4,700,748 granted Oct. 20, 1987, and 4,726,450 granted Feb. 23, 1988, both to Otis Elevator Company, describe an hydraulic elevator assembly which uses a motor driven spool valve controlled by a microprocessor to regulate hydraulic fluid flow to and from the plunger/cylinder lifting mechanism in the elevator. The spool valve is adjusted, in response to elevator speed and position sensed by the microprocessor, to start, stop, accelerate and decelerate the elevator. Flow of the hydraulic fluid from the plunger/cylinder to the storage tank passes through the spool valve. The spool valve is adjusted as conditions warrant to split fluid flow from the pump to the plunger/cylinder and to the storage tank; or to limit fluid flow from the plunger/cylinder to the storage tank.

The same spool valve also controls flow from the plunger/cylinder to the tank when the fluid is to be withdrawn from the plunger/cylinder to lower the car. The use of one spool valve to control all of the modes of fluid flow in the system results in a relatively complicated spool. The use of the same spool to control pressure equalization and fluid flow could result in a perceptible downward movement of the elevator car as descent begins if the spool valve is opened too far.

DISCLOSURE OF THE INVENTION

This invention relates to an improved motor controlled hydraulic elevator fluid flow regulating system wherein pressure equalization is controlled by a valve which is separate and apart from the spool valve and ensures equalization of pressure on both sides of the main check valve just prior to opening the main check valve and beginning descent of the elevator car. The fact that pressure equalization is accomplished allows the use of a smaller down piston to open the main check valve to commence downward movement of the elevator. The smaller piston requires less hydraulic fluid to operate whereby perceptible car movement will not occur when the hydraulic fluid is supplied to the down piston for the check valve-opening operation. The use of the separate valve also ensures that the elevator car will not precipitously drop if the valve were to be opened with the spool valve being simultaneously open. In such a case, hydraulic fluid would merely flow at a controlled rate from the plunger/cylinder through the valve, through the open spool valve to the storage tank. The main check valve will not open because: the pressure developed internally on the spool valve side of the main check valve will be low because of the open spool valve; there will be a large pressure differential acting across the main check valve holding it closed; the pilot pressure supplied to the down piston to provide the main check valve opening force will be low; and the area ratio of the down piston to the check valve is low. This provides an added measure of safety to the operation of the elevator. Longer main check valve seal life is also provided since opening against a pressure differential reduces seal life, and with the instant invention the pressure differential is eliminated before opening the main check valve.

It is therefore an object of this invention to provide an improved hydraulic elevator fluid flow regulating system.

It is a further object of this invention to provide a fluid flow regulating system of the character described wherein unduly accelerated downward movement of the elevator car is prevented.

It is an additional object of this invention to provide a fluid flow regulating system of the character described wherein a smaller down piston is employed.

It is another object of this invention to provide a fluid flow regulating system of the character described wherein downward movement of the elevator car is minimized when the main check valve is being opened to lower the car.

It is yet an additional object to provide a fluid flow regulating system of the character described which results in increased main check valve seal life.

BRIEF DESCRIPTION OF THE DRAWING

These and other objects and advantages of the invention will become more readily apparent from the following detailed description of a preferred embodiment thereof when taken in conjunction with the drawing which is a schematic view of a preferred embodiment of the invention.

BEST MODE FOR CARRYING OUT THE INVENTION

Referring to the drawing, the elevator car and plunger/cylinder components are denoted generally by numerals 20 and 22, respectively. Line 6 supplies hydraulic fluid to plunger/cylinder 22 from a pump 1 in a storage tank 24, and return. The pump 1 supplies hydraulic fluid through a check valve 2 to a spool valve 7 which is adjustable by means of a lead screw 8 operated by a motor 9. Motor 9 is a reversible electric stepping motor, and its operation is controlled by a microprocessor ("MP") as set forth in the above-noted prior art.

The uprun of elevator 20 is performed in the same manner as described in the aforesaid prior art, and therefore will only be briefly described herein. To begin the uprun, on signal from microprocessor MP, pump motor M is turned on and spool valve 7 is opened to enable pump 1 to impel hydraulic fluid from tank 24 through check valve 2 to spool valve 7. Since spool valve 7 is open, the hydraulic fluid merely flows through spool valve 7, lines 26 and 28 and back into tank 24.

The microprocessor MP then actuates stepping motor 9 to cause screw 8 to begin closure of spool valve 7. Spool valve 7 is quickly closed until pressure in line 3 increases to a point wherein check valve 4 begins to open. Initial movement of check valve 4 is sensed by sensor 5 which is connected to microprocessor MP.

Upon reception of a signal from sensor 5, microprocessor MP slows the closure rate of spool valve 7 so flow to plunger/cylinder 22 is gradually increased to provide a smooth lifting motion to car 20. The spool valve 7 is then closed sufficiently to provide the desired velocity to car 20 during its uprun. The car 20 is then gradually stopped by gradually reopening spool valve 7 until hydraulic pressure in plunger/cylinder 22 exceeds that in line 3 thus causing check valve 4 to close.

When a downrun of car 20 is to begin, pump 1 is turned off, and spool valve 7 is closed. Hydraulic fluid from line 6 passes through lines 30 and 32 to 3-way valve 12. Valve 12 may be any electrically controlled valve that may be biased to a particular position upon losing power. A solenoid valve is preferred, however.

The microprocessor MP opens valve 12 and hydraulic fluid flows through the solenoid valve into line 11. The fluid then passes into down piston chamber 36 and through line 34 to the pump side of main check valve 4. Since the fluid pressure in line 34 is the same as in line 6, fluid pressure on both sides of main check valve 4 is equalized and the only force holding valve 4 closed is derived from valve spring 4'. Check valve 37 is disposed in line 34 to prevent fluid from reaching the chamber 36 during an uprun, as described above.

The down piston 10 is mounted in chamber or cylinder 36 and includes a piston rod 13 which is aligned with main check valve 4, but does not normally contact the latter. When chamber 36 is pressurized (i.e. valve 12 is open), piston 10 and piston rod 13 move to the left as shown in the drawing, and piston rod 13 pushes valve 4 open. Since, as stated above, both sides of valve 4 are at equal pressure once valve 12 opens, only the force of spring 4' need be overcome to open valve 4. This allows the use of a smaller piston 10, and requires less hydraulic fluid in chamber 36 to actuate piston 10. As a result, less fluid is bled from plunger/cylinder 22 thereby resulting in minimal preliminary movement of car 20 when valve 12 is opened.

When valve 4 is opened, sensor 5 signals microprocessor MP to actuate stepping motor 9 to begin to open spool valve 7. Spool valve 7 is initially opened slowly to allow hydraulic fluid to flow past open valve 4 through line 3 and spool valve 7, and through lines 26 and 28 to tank 24.

The force which can be exerted by down piston 10 against check valve 4 is not enough to open the latter against a substantial pressure differential because of the small area of piston 10 and because the pressure supplied to down piston 10 is the same as the pressure on the pump side of the check valve. This is a safety feature which prevents opening of the main check valve 4 when spool valve 7 is open, which would result in a sudden fast start down of car 20.

The degree to which spool valve 7 is opened will determine the speed of descent of elevator car 20. The main check valve 4 in its fully open position will only have a small pressure drop across it so that piston 10 will be able to hold it open at normal flow rates. If the fluid flow rate (and associated elevator speed) is excessive across check valve 4, the pressure differential will increase and piston 10 will not be able to hold check valve 4 open. This is a safety feature to prevent excessive overspeed. Car position sensors of conventional construction (not shown) located in a hoistway (not shown) sense where car 20 is and transmit that information to microprocessor MP. The microprocessor uses that information to properly control spool valve 7. When the called floor is reached, spool valve 7 is closed, and valve 12 is closed. The pressure differential across valve 4 is thus increased, and valve 4 closes pushing piston 10 and rod 13 to the right as seen in the drawing. Fluid escapes from chamber 36 through valve 12 and flow regulator 14, and passes through line 28 to tank 24.

In the event of a power failure or other emergency, valve 12 is de-energized and closed, and elevator car 20 is stopped by the closing of main check valve 4. The rate at which main check valve 4 closes is limited by flow regulator 14 as fluid flows back through line 11 and valve 12 from chamber 36. Limiting the rate of check valve closing in this manner achieves a smooth stopping of the elevator during emergency conditions.

It will be readily appreciated that when a small piston is used relative to the size of the main check valve, the main check valve cannot be opened or held open when there is a significant pressure drop across the main check valve. This results in additional safety features. If the spool valve is open when valve 12 is energized and opened, fluid will flow through valve 12 and out to the tank through the open spool valve without building up significant pressure on the spool side of the main check valve, or at the down piston, thus the main check valve will not open. The elevator will descend at the rate controlled by oil flow through valve 12 which will be slow. If a large down piston were used without this added fluid connection around the main check valve, the elevator would almost immediately begin descending at high speed if the valve 12 was energized with the spool valve open—an unsafe condition.

Since many changes and variations of the disclosed embodiment of the invention may be made without departing from the inventive concept, it is not intended to limit the invention otherwise than as required by the appended claims.

What is claimed is:

1. An hydraulic elevator system comprising:

an elevator car;

a plunger/cylinder assembly for raising and lowering said elevator car;

a supply of hydraulic fluid and a fluid pump for delivering hydraulic fluid to said plunger/cylinder assembly;

an adjustable metering valve for controlling hydraulic fluid flow to and from said plunger/cylinder assembly;

biased check valve means interposed between said plunger/cylinder assembly and said metering valve said check valve means normally being closed by a positive fluid pressure differential on the plunger/-cylinder side thereof, said check valve means having a plunger/cylinder side communicating with said plunger/cylinder and a metering valve side communicating with said metering valve;

fluid actuated means operable with fluid from said plunger/cylinder assembly to selectively open said check valve means to allow withdrawal of hydraulic fluid from said plunger/cylinder assembly during a downrun of said elevator car; and a valve means including a single valve, said valve means interconnecting said plunger/cylinder and said metering valve sides of said check valve means.

2. The elevator system of claim 1 further comprising:

means for connecting said valve with said fluid actuated means for delivering hydraulic fluid to said fluid actuated means while pressure on both sides of said check valve means is equalizing to enable said fluid actuated means to then open said check valve means.

3. The hydraulic elevator system of claim 1 further comprising:

means for preventing actuation of said fluid actuated means when said metering valve is at a partial or full open setting.

* * * * *